US005415460A

United States Patent [19]

Laney

[11] Patent Number: 5,415,460

[45] Date of Patent: May 16, 1995

[54] POSTURE STOOL

[75] Inventor: Wayne G. Laney, Yakima, Wash.

[73] Assignee: Abe Gonzales, Yakima, Wash. ; a part interest

[21] Appl. No.: 521,903

[22] Filed: May 11, 1990

[51] Int. Cl.[6] ..... A47C 16/00

[52] U.S. Cl. ..... 297/423.41

[58] Field of Search ..... 297/438, 439, 423, 426, 297/461, 462, 254, 423.39, 423.41, 423.1, 423.16; D6/349, 350, 352, 342, 500, 501, 381, 375

[56] References Cited

U.S. PATENT DOCUMENTS

| | | | |
|---|---|---|---|
| 48,638 | 7/1865 | Adams | 297/439 |
| D. 167,738 | 9/1952 | Campbell | D6/381 X |
| D. 262,921 | 2/1982 | Poole | D6/349 X |
| D. 275,914 | 10/1984 | Gersin | D6/357 |
| D. 297,790 | 9/1988 | Melvin | D6/350 |
| 1,013,032 | 12/1911 | Lund | 108/92 |
| 1,798,472 | 3/1931 | Kelly | 297/439 X |
| 3,005,662 | 10/1961 | Emery | 297/438 |
| 3,155,364 | 11/1964 | Borg | 297/439 |
| 4,076,876 | 2/1978 | Bowles | 297/439 X |
| 4,090,268 | 5/1978 | Turner | 297/438 X |
| 4,549,767 | 10/1985 | Hampshire et al. | 297/439 |
| 4,692,954 | 9/1987 | Scott | 5/443 |
| 4,910,818 | 3/1990 | Grabill et al. | 297/439 X |
| 4,991,908 | 2/1991 | Krechel | 297/439 |

*Primary Examiner*—Jose V. Chen
*Attorney, Agent, or Firm*—Stratton Ballew

[57] ABSTRACT

A posture stool for the relief of transitory or chronic lower back pain, comprising a rectilinear base supporting a center step inclined at an angle to the horizontal, with a lower step on each side of the center step, the lower steps being of the same size as the center step and parallel with and equidistant from the center step and inclined at a lesser angle to the horizontal than the center step.

2 Claims, 3 Drawing Sheets

POSTURE STOOL

BACKGROUND OF THE INVENTION

During my chiropractic training, I studied the effect of biomechanics as it relates to the entire spine, and especially the lumbosacral region. While studying the basic concepts of how the stress of simple gravity can affect the entire spine and pelvic girdle, I learned that, by some alternating of the posture of the leg, stress on the spine could be eased. After I began my practice, I started dealing with the needs of patients experiencing real pain and suffering that did not always respond quickly to selective modes of conservative health care.

I saw a need to help people who, while sitting or standing, were undergoing acute low back pain of differing origins, as well as those having longer term spinal stress. I soon realized that there is not a product on the market available to these patients, that would reduce the pain by helping to minimize the amount of stress on their spines.

After thirteen years of trying to give my patients something they could do at home to alternate their sitting and standing posture stress, I concluded that there needed to be something developed that would give the average adult a way of eliminating sitting and standing stress accumulation. I suggested, at various times, that patients try using books, pieces of wood, or whatever was available, to put their feet upon to alternate spinal stresses. What this seemed to do for patients was, at times, impressive, but not always. What was needed was a more consistent height, angle and surface spatial relationship that would serve the purpose for adults having a wide range of physical stature.

DESCRIPTION OF THE RELATED ART

The previous foot/posture stool designs primarily have one thing in common: they all have a raised and/or variable tilt surface, but they do not allow for alternating foot levels side-to-side, with a raised section usable with either foot.

BRIEF DESCRIPTION OF THE INVENTION

The posture stool of this invention is molded of a single piece, and has a rectangular base which supports a raised middle step with two lower steps, one on either side of the middle step, and parallel to it. The middle step is approximately twice as high above the bottom of the base as the two lower steps, the two lower steps being of equal distance above the bottom of the base. The two lower steps are tilted upward from front to back of the stool. The middle step is tilted upward, from the front of the stool to the back, at a greater angle than the two lower steps. All three steps are of a size to accommodate a large size man's shoe. The front of the stool is provided with a toe hole for easy movement of the stool around a floor, and for convenience in carrying.

DETAILED DESCRIPTION OF THE INVENTION

Figure 1:
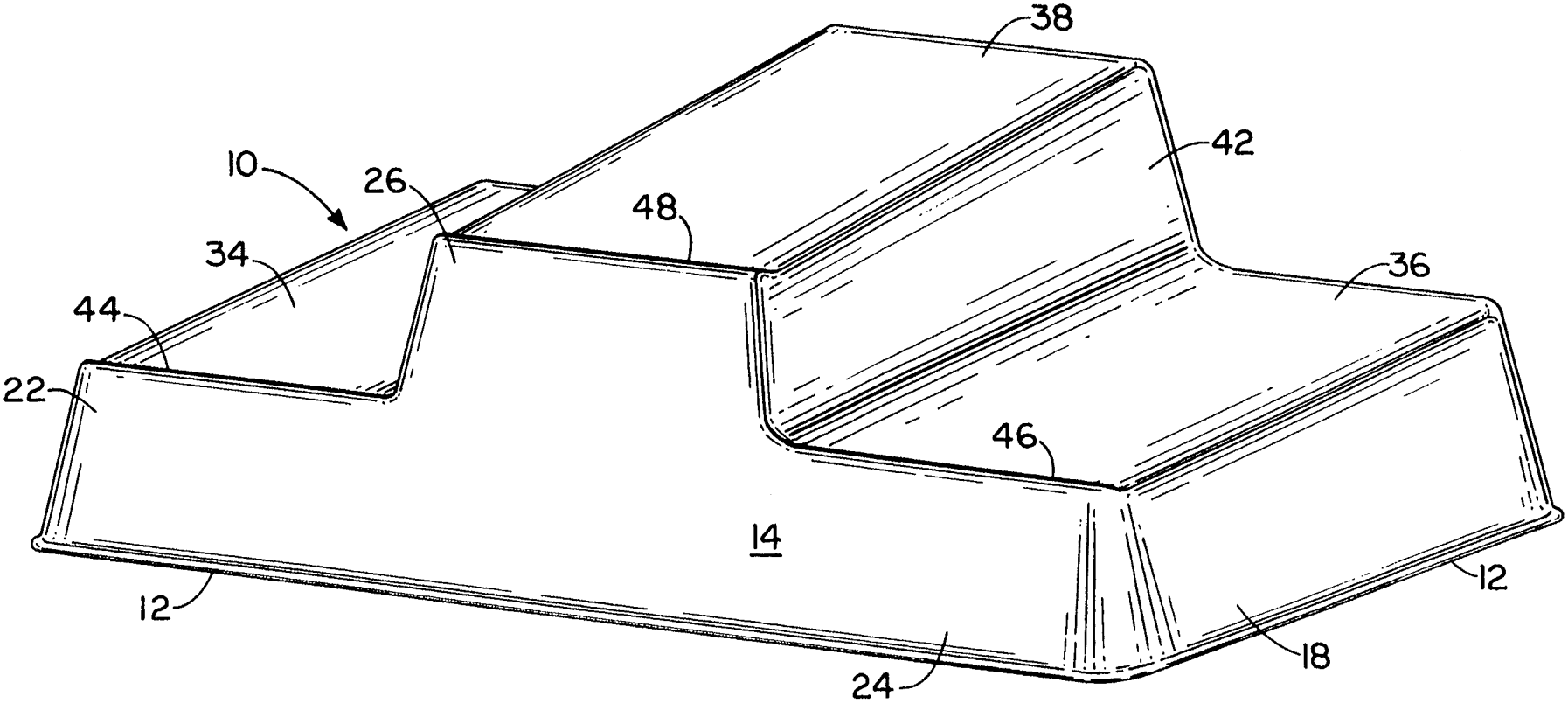
FIG. 1 is a perspective view of the posture stool of this invention.

Stool 10 is molded of plastic in a single piece. Stool 10 is generally rectangular in plan view, and features rounded corners. Base 12 underlies and supports circumscribing walls comprising front wall 14, left side wall 16, right side wall 18, and back wall 20, all of which walls slope inward as they extend upward from base 12.

Front wall 14 comprises front left section 22 and front right section 24, which are of equal height above base 12, and front center section 26 which extends higher above base 12 than sections 22 and 24. Back wall 20 comprises back left section 28 and back right section 30, which are of equal height above base 12, and back center section 32 which extends higher above base than sections 28 and 30.

Considering base 2 as being oriented horizontally, it may be seen in FIG .3 that the upper edge of left side wall 16 slopes upwardly from where it joins front wall 14 to where it joins back wall 20. Similarly, right side wall 18 slopes upwardly from where it joins front wall 14 to where it joins back wall 20. It can thus be seen that left foot surface 34 which is supported by front left section 22, left side wall 16 and back left section 28 is tilted upward from the front of stool 10 to the back of stool 10. Similarly, right foot surface 36 which is supported by front right section 24, right side wall 18 and back right section 30 is tilted upward from the front of stool 10 to the back of stool 10. The angle of upward tilt of left step 34 and right step 36 is approximately 3 degrees from the horizontal.

Figure 3:
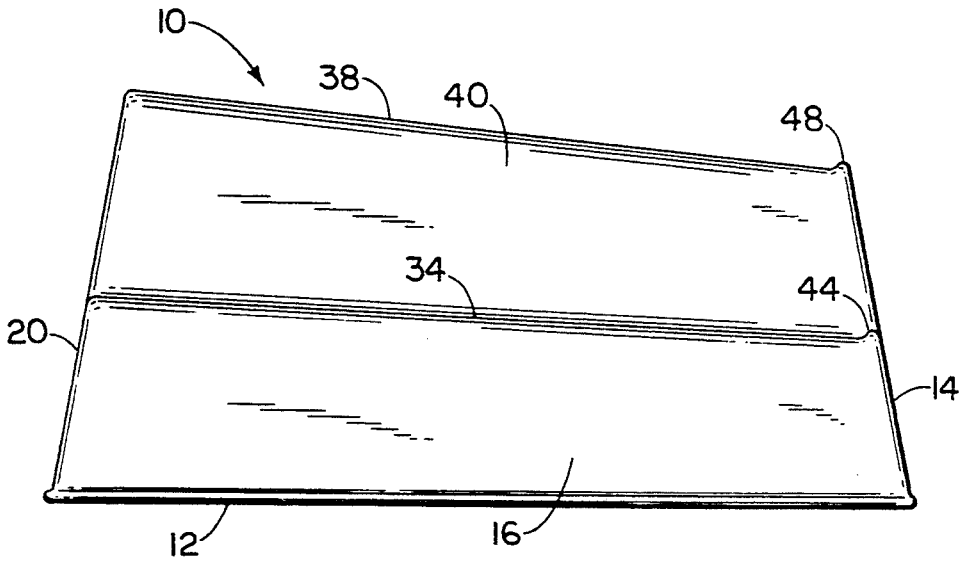
FIG. 3 is a side elevational view of the stool of FIG. 1.
Figure 2:
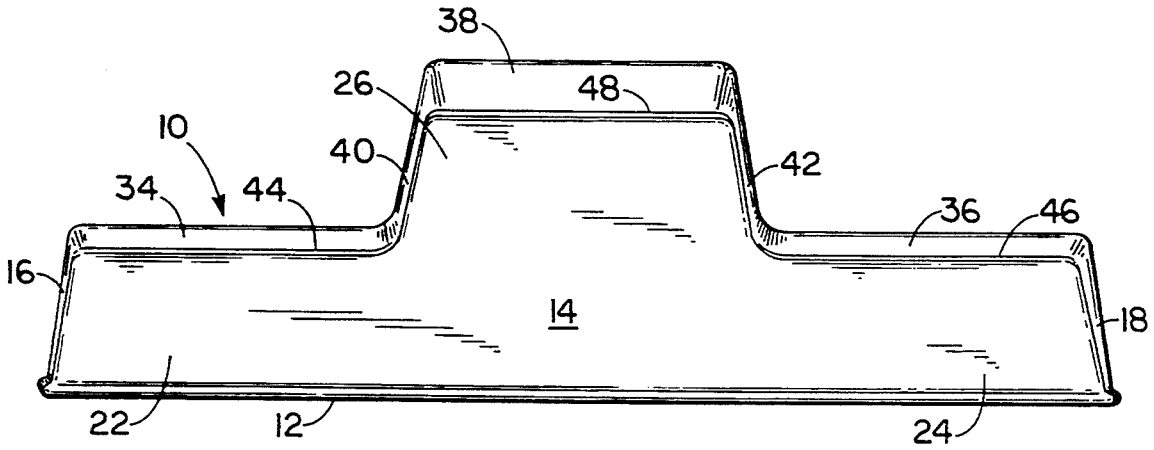
FIG. 2 is a front elevational view of the stool of FIG. 1.
Figure 4:
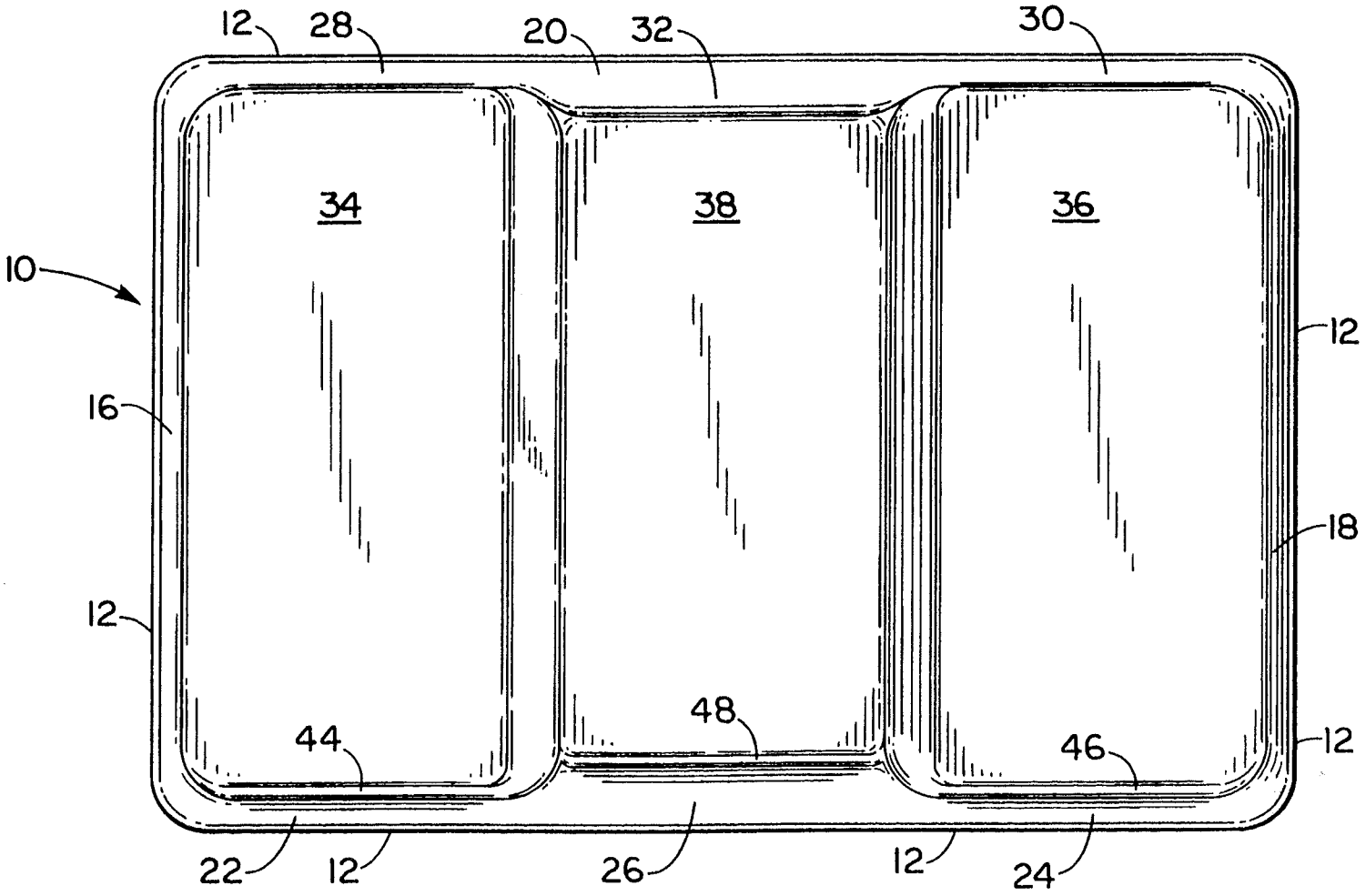
FIG. 4 is a plan view of the stool of FIG. 1.

It may be seen in FIGS. 3 and 4 that back center section 32 extends higher above base 2 than does front center section 26. Center step 38 is supported by front center section 26, back center section 32 and by left center wall 40 and right center wall 42. It may be seen, particularly in FIG. 3, that left center wall 40 and right center wall 42 are wider where they join back center section 32 than where they join front center section 26. It can thus be seen that center step 38 is tilted upward from the front of stool 10 to the back of stool 10 at a greater angle to the horizontal than are left step 34 and right step 36. The angle of upward tilt of center step 38 is approximately 6 degrees from the horizontal.

Left step 34 is provided with lip 44 at its lower end, right step 36 is provided with lip 46 at its lower end, and center step 38 is provided with lip 48 at its lower end. The purpose of lips 44, 46 and 48 is to keep the user's foot from sliding down off whichever step it happens to be resting.

Front center section 26 is provided with a cutout 50 having the approximate shape of the cross-section of the toe of a shoe. Cutout 50 has horizontal lower edge 52 in near proximity to base 12. Side edge 54 and side edge 56 of cutout 44 are spaced far enough apart from each other, and upper edge 58 is spaced far enough above lower edge 52, to permit the entry of the toe of a man's shoe for the purpose of shifting the position of stool 10. Cutout 50 is also useful as a convenient hand carry grip.

While stool 10 may be manufactured in different sizes, and different angles of tilt of the steps, the preferred embodiment described and illustrated herein is suitable for use by persons from approximately 4'6" tall to persons approximately 6'6" tall, which is most of the adult population.

By providing approximately nine alternating leg posture choices while sitting, and four leg posture choices while standing, this stool will greatly diminish biomechanical insult to lumbosacral/sacroiliac regions, compared to the use of conventional posture/foot stools, or the use of none at all.

While this invention is susceptible of embodiment in different forms, the drawings and the specification illustrate the preferred embodiment of the invention, with the understanding that the present disclosure is to be considered an exemplification of the principles of the invention, and the disclosure is not intended to limit the invention to the particular embodiment described.

I claim:

1. A three-position footrest for placement thereon of the soles of the feet, comprising:

a rectilinear base;

a first flat, oblong footrest element and a second flat, oblong footrest element of the same size as the first footrest element, both elements being positioned above the base and within the upward projection of the base outline, and tilted at an angle with respect to the base, said first footrest element and second footrest element being coplanar, and with longer sides parallel and spaced apart;

a third flat, oblong footrest element of the same size as the first and second footrest elements, having walls depending from the longer sides, and positioned above the base between the first footrest element and the second footrest element, at a greater elevation above the base than either, and tilted at a greater angle with respect to the base than the first footrest element and the second fotrest element, said depending walls joining and supported by adjacent longer sides of the first and second footrest elements; and a circumscribing support wall structure extending upward from the base and supporting all of the free edges of the first, second and third footrest elements, and joined to the free ends of the depending walls.

2. The footrest of claim 1 wherein one of the circumscribing support walls has a toehole therein, said toehole defined by a lower edge near and parallel to the plane of the rectilinear base, side edges extending upward from each end of said lower edge of the toehole, and a top edge joining the side edges.

* * * * *